US009022510B2

(12) United States Patent
Sasaki et al.

(10) Patent No.: US 9,022,510 B2
(45) Date of Patent: May 5, 2015

(54) RECORDING APPARATUS

(75) Inventors: Tsuneyuki Sasaki, Matsumoto (JP); Akira Ishikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 106 days.

(21) Appl. No.: 13/565,917

(22) Filed: Aug. 3, 2012

(65) Prior Publication Data

US 2013/0044153 A1 Feb. 21, 2013

(30) Foreign Application Priority Data

Aug. 17, 2011 (JP) ..... 2011-178266

(51) Int. Cl.

| | |
|---|---|
| ***B41J 15/04*** | (2006.01) |
| ***B41J 11/00*** | (2006.01) |
| ***B65H 23/16*** | (2006.01) |
| ***B65H 23/195*** | (2006.01) |

(52) U.S. Cl.

CPC ..... *B41J 15/04* (2013.01); *B41J 11/002* (2013.01); *B65H 23/16* (2013.01); *B65H 23/195* (2013.01); *B65H 2403/942* (2013.01); *B65H 2513/11* (2013.01); *B65H 2515/31* (2013.01); *B65H 2515/40* (2013.01); *B65H 2515/842* (2013.01); *B65H 2553/412* (2013.01); *B65H 2801/36* (2013.01)

(58) Field of Classification Search

CPC ..... B41J 11/002

USPC ..... 347/16

See application file for complete search history.

(56) References Cited

U.S. PATENT DOCUMENTS

| | | | | |
|---|---|---|---|---|
| 3,648,991 | A * | 3/1972 | Volkers | 432/31 |
| 2003/0161552 | A1* | 8/2003 | Shima et al. | 382/312 |
| 2004/0022568 | A1* | 2/2004 | Menendez et al. | 400/76 |
| 2005/0151815 | A1* | 7/2005 | Kanai et al. | 347/102 |

FOREIGN PATENT DOCUMENTS

| | | |
|---|---|---|
| JP | 05-286130 | 11/1993 |
| JP | 4429923 | 3/2010 |

* cited by examiner

*Primary Examiner* — Manish S Shah
*Assistant Examiner* — Jeffrey C Morgan
(74) *Attorney, Agent, or Firm* — Workman Nydegger

(57) ABSTRACT

A recording apparatus includes a transporting device that transports a recording medium, a recording head that ejects fluid to the recording medium, a first supporting surface that supports the recording medium at a position opposed to the recording head, a heating device that has a second supporting surface that supports the recording medium at an upstream side of a transport direction more than the recording head along with heating the recording medium on the second supporting surface, a floating detection device that detects floating of the recording medium with respect to at least one of the first supporting surface and the second supporting surface, and a control device that controls a heating state of the recording medium on the second supporting surface, based on the detection result of the floating detection device.

8 Claims, 4 Drawing Sheets

RECORDING APPARATUS

BACKGROUND

This application claims priority to Japanese Patent Application No. 2011-178266 filed on Aug. 17, 2011. The entire disclosure of Japanese Patent Application No. 2011-178266 is hereby incorporated herein by reference.

1. Technical Field

The present invention relates to a recording apparatus.

2. Related Art

An example of an ink jet printer is well known as one of recording apparatuses that record images or characters by ejecting fluid to a recording medium. In the ink jet printer, if an ink (fluid) requiring penetration drying or evaporative drying is used, there is a need to install a heating device for drying the ink ejected to the recording medium.

In the Japanese Patent No. 4429923, there is disclosed means in which a preheating device which preheats the recording medium is installed at the upstream side of an ink jet head in a transport path of the recording medium and the preheating device heats a recording medium above a predetermined temperature in advance before ejecting an ink to suppress an clumping, bleeding or the like of the landed ink, thereby being able to realize a high quality printing image.

Incidentally, with regard to the drying of the ink, although the higher temperature of the recording surface of the recording medium when landing, the more preferable, if the recording medium is rapidly heated in a printing area, wrinkles which are a cause of a poor printing are created through elongation due to thermal expansion and the like. With respect to the wrinkles, in the related art, there has been proposed a wrinkle-countermeasure in which the preheating device is installed so that the recording medium is preheated before entering the printing area and thereby a difference in the thermal expansion is mitigated. That is, temperature control is performed so that a target temperature in the printing area is equal to a heating temperature in the preheating device.

However, even though the temperature control is performed in this way, as a practical problem, creation of the wrinkle on a recording medium by the insufficient heating of the preheating device has been observed. As such cause, for example, it is considered that there is a cause that in a case of adopting a heat conduction manner which heats a supporting member for supporting the recording medium as in the related art, the heating is insufficient due to a poor contact with the recording medium. In addition, it is also considered that there are causes by influences of other external disturbances (for example, ambient temperature, humidity or the like).

Further, with respect to this problem, it is considered that a platen for supporting the recording medium in the printing area has ribs attached thereto and the ribs make the heat elongation of the recording medium be absorbed and mitigated, but the platen having the ribs has a high cost and further there is a possibility that would affect the image quality since a temperature distribution may be created between sites which contacts the ribs and in sites which do not contact the ribs and due to that, the drying of the ink may be uneven.

SUMMARY

An advantage of some aspects of the invention is to provide a recording apparatus which is able to realize a high quality printing image by providing a sufficient preheating.

According to an aspect of the invention, there is provided a recording apparatus including a transporting device that transports a recording medium, a recording head that ejects fluid to the recording medium, a first supporting surface that supports the recording medium at a position opposed to the recording head, a heating device that has a second supporting surface that supports the recording medium further to the upstream side in the recording head in a transport direction that the recording head along with heating the recording medium on the second supporting surface, a floating detection device that detects floating of the recording medium with respect to at least one of the first supporting surface and the second supporting surface, and a control device that performs control regarding a heating state of the recording medium on the second supporting surface, based on the detection result of the floating detection device.

By employing such a configuration in the invention, the insufficient heating which could not determined with only control of the preset temperature of the heating device preheating the recording medium can be determined by floating with respect to the supporting surface of the recording medium and on the basis of the determination, the recording medium is sufficiently heated before entering the printing area by controlling the heating state of the recording medium on the second supporting surface. If the recording medium in the heating device is sufficiently heated, since wrinkle is not created due to the heat expansion difference even in the first supporting surface, the recording medium in the printing area can be supported on the flat plate without ribs and accordingly the image printing can be realized with high quality.

In the recording apparatus, the control device may control the driving of the transporting device to provide a tension to the recording medium on the second supporting surface, based on the detection result of the floating detection device.

By employing such a configuration, in the aspect of the invention, tension provided to the recording medium through driving of the transporting device and the heating state of the recording medium on the second supporting surface are controlled. That is, by providing such a tension, since flatness of the recording medium is secured and an appropriate state without floating with respect to the second supporting surface is maintained, the recording medium may be sufficiently heated on the second supporting surface.

In the recording, the control device may control the driving of the heating device to increase the heat amount per unit time which is provided to the recording medium on the second supporting surface, based on the detection result of the floating detection device.

By employing such a configuration, in the aspect of the invention, greater heat amount to the recording medium is provided through the driving of the heating device and the heating state of the recording medium is controlled on the second supporting surface. That is, since heating for compensating for insufficient heating may be performed, the recording medium can be sufficiently heated on the second support surface.

In the recording apparatus, the floating detection device may detects floating, based on the temperature distribution of the recording medium.

By employing such a configuration, in the aspect of the invention, if the recording medium is floated with respect to the supporting face, difference in height is created by the floating and the temperature distribution is created, and thus the floating is detected based on the temperature distribution.

In the recording, the transporting device may include a transporting roller pair pinching the recording medium with a gap in a width direction intersecting the transport direction between the first supporting surface and the second supporting surface, and the floating detection device is installed to be able to detect the floating of the recording medium at a position corresponding to the gap.

By employing such a configuration, in the aspect of the invention, the floating is detected at the positions corresponding to the gap since the heat elongation of the recording medium retries in the gap which is not pinched by the transporting roller pair and the floating creates beginning from the elongation as a starting point.

In the recording apparatus, the transporting roller pair may include a first gap having a predetermined distance and a second gap having a distance greater than the first gap as the gap, and a floating detection device is installed to be able to detect the floating of the recording medium at a position corresponding to the second gap.

By employing such a configuration, in the aspect of the invention, the second gap is greater than the first gap and guides the floating in the second gap to effectively detect the floating at the position corresponding to the gap since the heat elongation of the recording medium retries in the more great gap of gaps which is not pinched by the transporting roller pair and the gap becomes a starting point of floating.

In the recording, the second gap may be installed outside the printing area by the recording head in the width direction.

By employing such a configuration, in the aspect of the invention, a high quality printing can be realized by not exerting on the printing area influence of the floating of the recording medium guided to the second gap.

BRIEF DESCRIPTION OF THE DRAWINGS

The invention will be described with reference to the accompanying drawings, wherein like numbers reference like elements.

DESCRIPTION OF EXEMPLARY EMBODIMENTS

Each of embodiments of a recording apparatus according to the aspect of the invention will be explained with respect to the drawings. Further, in each drawing used in the following description, in order to show in size which each member can be recognized, a scale of each member is changed appropriately. In the embodiment, as the recording apparatus according to the invention, an ink jet printer (hereinafter, simply referred to as a printer).

Figure 1:
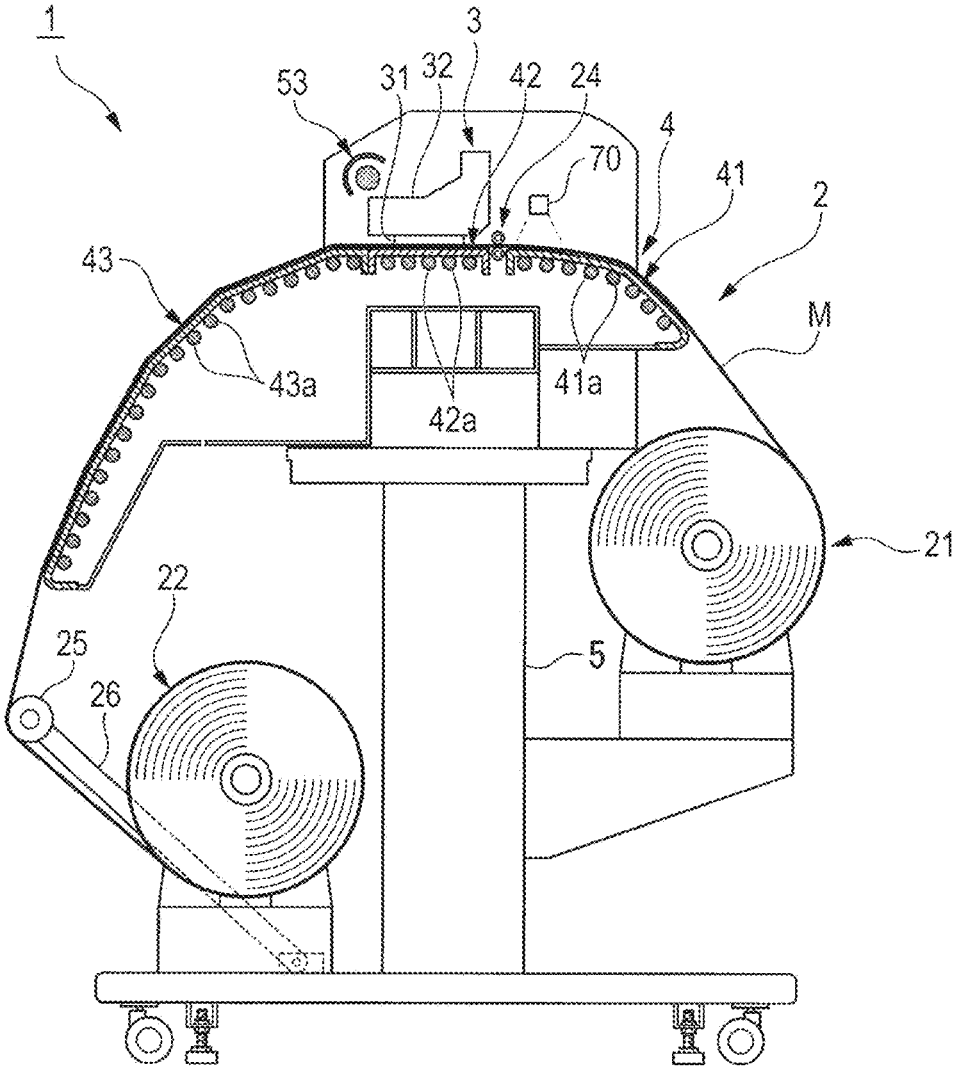
FIG. 1 is a configuration diagram illustrating a printer according to an embodiment of the invention.

FIG. 1 shows a configuration diagram illustrating a printer 1 according to the embodiment of the invention.

The printer 1 is a large format printer (LFP) that handles relatively large sized recording medium (recording medium) M. The recording medium M of the embodiment is formed from a polyvinyl chloride film, for example.

As shown in FIG. 1, the printer 1 has a transporting section (transporting device) 2 that transports the recording medium M in a roll to roll method, a recording section 3 that records images, characters or the like by ejecting ink (fluid) to the recording medium M, and a heating section 4 that heats the recording medium M. Each of these constituent sections is supported in a main body frame 5.

The transporting section 2 has a supplying roll 21 that sends out the roll-like recording medium M, a take-up roll 22 that takes up the supplied recording medium M. The transporting section 2 has a transporting roll pair 24 that transports the recording medium M in the transport path between the roll 21 and the roll 22. Further, the transporting section 2 has a tension roll 25 that provides tension to the recording medium M. The tension roll 25 is supported to a rocking frame 26.

The recording section 3 has an ink jet head (recording head) 31 that ejects ink with respect to the recording medium M which is transported and a carriage 32 in which the ink jet head 31 is installed and freely moves back and forth in the width direction (a direction perpendicular to the paper surface in FIG. 1). The ink jet head 31 includes a plurality of nozzles and has a configuration which is able to eject the ink required to select penetration drying or evaporation drying according to the relation with the recording medium M.

The heating section 4 is configured to rapidly dry and fix ink on the recording medium M through heating the recording medium M and thus to promote the printing quality by suppressing bleeding or blurring.

The heating section 4 has a preheating section (heating device) 41 that heats the recording medium M in advance further to the upstream side in the transport direction than the position at which the recording section 3 is installed, a recording medium support section-heating section 42 that heats the recording medium M at a position opposed to the recording section 3 and an post-heating section 43 that heats the recording medium M further to the downstream side in the transporting direction than the position where the recording section 3 is installed.

In the embodiment, the heating temperature of a heater 41*a* is set to 40° C. in the preheating section 41. Further, in the embodiment, the heating temperature of a heater 42*a* is set to 40° C. (target temperature) similar to the heater 41*a* in the recording medium support section-heating section 42. Further, in the embodiment, a heating temperature of the heater 43*a* is set to 50° C. which is more than those of the heaters 41*a* and 42*a* in the post-heating section 43.

The preheating section 41 is configured to rapidly accomplish drying from a time point when ink is landed by gradually increasing the temperature from normal temperature toward the target temperature (a temperature in the recording medium support section-heating section 42).

Further, the recording medium support section-heating section 42 is configured to allow the ink to land on the recording medium M in a state that the target temperature is maintained and to rapidly perform the drying from a time point when ink is landed.

Further, the post-heating section 43 is configured to increase the temperature of the recording medium M up to a temperature more than the target temperature and to rapidly dry any ink that has still not been dried from ink landed on the recording medium M and to completely dry and fix the ink landed on the recording medium M at least before being wound up on the roll 22.

Next, a characteristic configuration in the heating section 4 of the embodiment will be explained.

Figure 2:
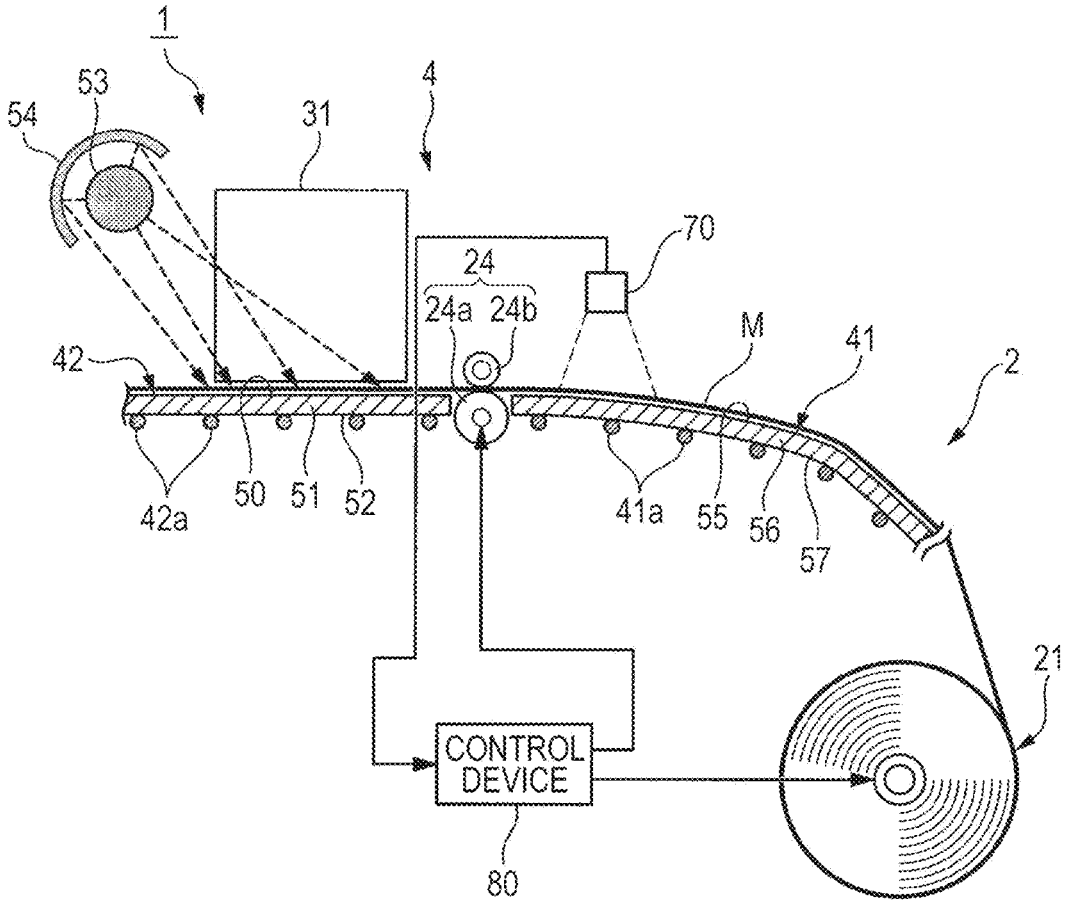
FIG. 2 is a configuration diagram illustrating a heating section according to the embodiment of the invention.

FIG. 2 shows a configuration diagram illustrating the heating section 4 in the embodiment of the invention. In FIG. 2, portions pertaining to the preheating section 41 and the recording medium support section-heating section 42 in the heating section 4 are illustrated schematically.

As shown in FIG. 2, the recording medium support section-heating section 42 has a first supporting member 51 including a first supporting surface 50 on which the recording medium M is supported. The first supporting member 51 is a flat plate made of metal and extended in the width direction (a direction perpendicular to the paper surface in FIG. 2) intersecting the transport direction of the recording medium M. The first supporting member 51 has a width greater than the width of the recording medium M in order to support the recording medium M over the width direction.

On the opposite side surface 52 to a first supporting surface 50 of the first supporting member 51, the heater 42*a* is wired. The heater 42*a* is a tube heater and is affixed to the opposite side surface 52 by aluminum tape which is not shown. Accordingly, the heater 42*a* is constituted to heat the first supporting member 51 by heat conduction from the opposite side surface 52 as well as to indirectly heat the recording medium M which is supported on the first supporting surface 50 from the rear surface side.

An infrared heater 53 is installed at a position opposed to the first supporting surface 50 of the first supporting member 51. The infrared heater 53 is spaced by a predetermined distance from the first supporting surface 50 and also is installed to extend over the width direction of the first supporting member 51. Accordingly, the infrared heater 53 is constituted to apply radiation heating to the first supporting member 51 by irradiating infrared energy directly to the first supporting surface 50 as well as to apply radiation heating directly to the recording surface side of the recording medium M in a case where the recording medium M is supported on the first supporting surface 50.

The infrared heater 53 is constituted to irradiate electromagnetic waves having a wavelength in which a main part of the peak of the radiation spectrum includes an area of 2 μm to 4 μm. Thereby, the infrared heater 53 can vibrate water molecules included in the ink without increasing temperature of a constituent member which does not include the surrounding water molecules and the like to promote rapid drying by their frictional heat. Accordingly, the majority of the infrared energy is absorbed by the ink and thus the ink landed on the recording surface is heated intensively.

The infrared heater 53 has a refractive plate 54 and is constituted to irradiate the infrared obliquely further in the downstream side of the transport direction than the ink jet head 31 (shown by the dotted line in FIG. 2) toward the first supporting surface 50. The infrared irradiation range of the infrared heater 53 is set on the first supporting surface 50 and is constituted to heat promptly the ink landed on the recording surface including the printing area by the ink jet head 31. The reflective plate 54 according to the embodiment has a substantially half-arc shape and is disposed at the rear side opposite to the infrared irradiation direction. The reflective plate 54 is made of a metal such as an Al material or a SUS material and is formed by mirror finishing the surface thereof.

The preheating section 41 has a second supporting member 56 including a second supporting surface 55 that supports the recording medium M in the upstream side of the transport direction more than the first supporting member 51. The second supporting member 56 is a plate material made of a metal in which a curve or bend is formed and has a shape of convexes which are substantially curved overall and formed on the second supporting surface 55 side. The second supporting member 56 is also disposed to extend with a similar width to that of the first supporting member 51 in the width direction. The first supporting surface 50 and the second supporting surface 55 forms a transport path of the recording medium M in cooperation with each other.

The heater 41*a* is wired in an opposite side surface 57 to the second supporting surface 55 of the second supporting member 56. The heater 41*a* is a tube heater and is attached to the opposite side surface 57 by aluminum tape which is not shown. Accordingly, the heater 41*a* is constituted to heat the second supporting member 56 through heat conduction from the opposite side surface 57 as well as to indirectly heat the recording medium M supported on the second supporting surface 55 from the rear surface side.

A floating detection sensor 70 (detection device) is mounted at a position opposite to the second supporting surface 55 of the second supporting member 56. The floating detection sensor 70 according to the embodiment is constituted to detect the floating of the recording medium M with respect to the second supporting surface 55.

The floating detection sensor 70 is electrically connected to a control device 80. The control device 80 is constituted to control the heating state of the recording medium M on the second supporting surface 55, based on the detection result of the floating detection sensor 70. The control device 80 according to the embodiment has a computer system that performs control regarding the driving of the transporting section 2, based on the detection result of the floating detection sensor 70.

Figure 3:
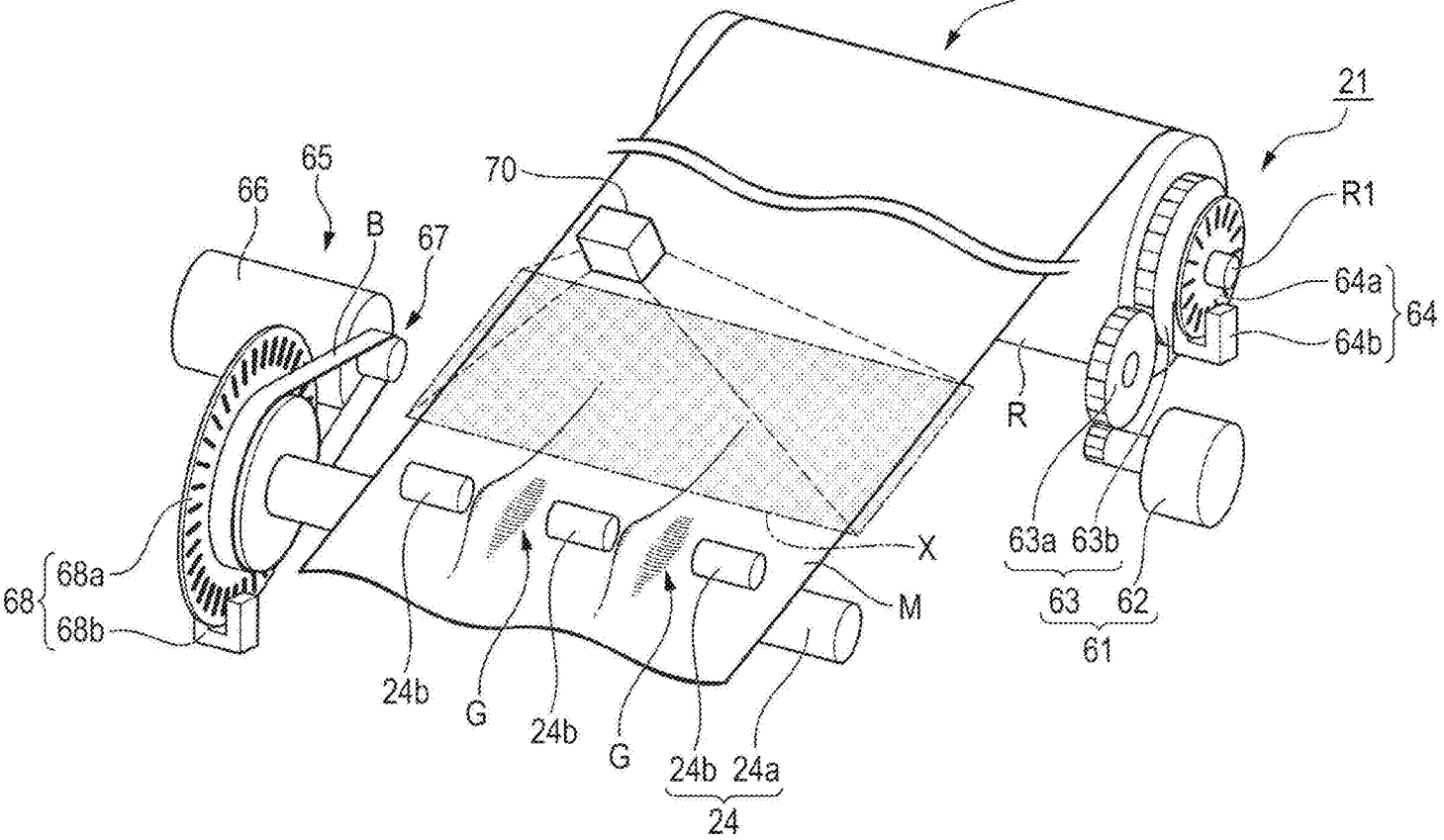
FIG. 3 is a perspective view illustrating a configuration of a main part of a transporting section and an arrangement of a floating detection sensor according to the embodiment of the invention.

FIG. 3 shows a perspective view illustrating a configuration of the main parts of the transporting section 2 and an arrangement of the floating detection sensor 70 according to the embodiment of the invention. In FIG. 3, portions pertaining to the roll 21 and the transporting roll pair 24 in the transporting section 2 are illustrated schematically.

The sending roll 21 has a spindle R1 that holds a roll-like recording medium M, a roll driving device 61 that rotationally drives the spindle R1 and a rotation detection device 64 that detects the rotation of the spindle R1.

The roll driving device 61 has a motor 62 and a power transmission mechanism 63. The motor 62 is electrically connected to the control device 80 and is constituted to control the driving thereof by the control device 80. For example, the motor 62 is constituted to be able to switch between a forward drive/a reverse drive under control of the control device 80. The power transmission mechanism 63 has a first gear 63*a* that is engaged with rotation axle of the motor 62 and a second gear 63*b* that is integrally engaged with the first gear 63*a* and mounted rotatably with the spindle R1.

The rotation detection device 64 has a disk-shaped scale 64*a* that has a plurality of a light receiving sections on outer circumference and a photosensor 64*b* that includes light receiving section for receiving light which has passed through a light emitting section emitting a light toward the light receiving section and the light transmitting section. The disk-shaped scale 64*a* is rotatably integrally mounted on the spindle R1. The photosensor 64*b* is electrically connected to the control device 80 and is constituted to output the detection signal to the control device 80. The control device 80 is able to calculate a rotation amount (rotation angle), a rotation speed or the like per unit time of spindle R1 by receiving the output signal from the rotation detection device 64.

The transporting roll pair 24 is installed between the first supporting surface 50 and the second supporting surface 55 (referring to FIG. 2) and has a driving roller 24*a* and a following roller 24*b*. The driving roller 24*a* is constituted to be rotatably driven by a roller driving device 65. In a while, the following roller 24*b* is driven to rotate by a rotation drive of the driving roller 24*a*. The driving roller 24*a* has the roller driving device 65 and a rotation detection device 68.

The roller driving device 65 has a motor 66 and the power transmission mechanism 67. The motor 66 is electrically connected to the control device 80 and is constituted to control the driving thereof by the control device 80. For example, the motor 66 can be switched between forward rotation/reverse rotation under the control of the control device 80. The power transmission mechanism 67 has a belt B that passes over between the rotation axis of the motor 66 and a shaft end of the driving roller 24*a*.

The rotation detection device 68 has a disk-shaped scale 68*a* that has a plurality of the light receiving sections on outer circumference and a photosensor 68*b* that includes a light emitting section which emits a light toward the light receiving section and a light receiving section which receives a light passed through the light receiving section. The disk-shaped scale 68*a* is assembled on the shaft end of the driving roller 24*a* to be integrally rotatable. The photosensor 68*b* is electrically connected to the control device 80 and is constituted to output the detection signal to the control device 80. The control device 80 is able to calculate a rotation amount (rotation angle), a rotation speed or the like per unit time of the driving roller 24*a* by receiving the output signal from the rotation detection device 68.

The driving roller 24*a* is installed to extend in the width direction perpendicular to the transport direction and is disposed in the rear surface of the recording medium M. In a while, the following roller 24*b* is provided in plural with a gap G in the width direction and is disposed on the recording surface side of the recording medium M. The following roller 24*b* is supported to a holder which is not shown and is also biased toward the circumferential surface of the driving roller 24*a* by a spring member which is not shown. The transporting roll pair 24 of the configuration as mentioned above is constituted to pinch the recording medium M with the gap G in the width direction.

The floating detection sensor 70 is installed to be able to detect the floating of the recording medium M at the position corresponding to the gap G. A detection area X of the floating detection sensor 70 is set in a vicinity of the transporting roll pair 24 that is further to the upstream side in the transporting direction than the transporting roll pair 24. Further, the detection area X of the floating detection sensor 70 is set to a size that can include the detection area X of the floating detection sensor 70 is extended in the width direction and the length in the width direction is set to a size that all of the gap G which is dotted can be included. The floating detection sensor 70 of the embodiment has infrared array sensors which are able to detect a temperature distribution in the detection area X and is constituted to detect the floating of the recording medium M, based on the temperature distribution.

Figure 4:
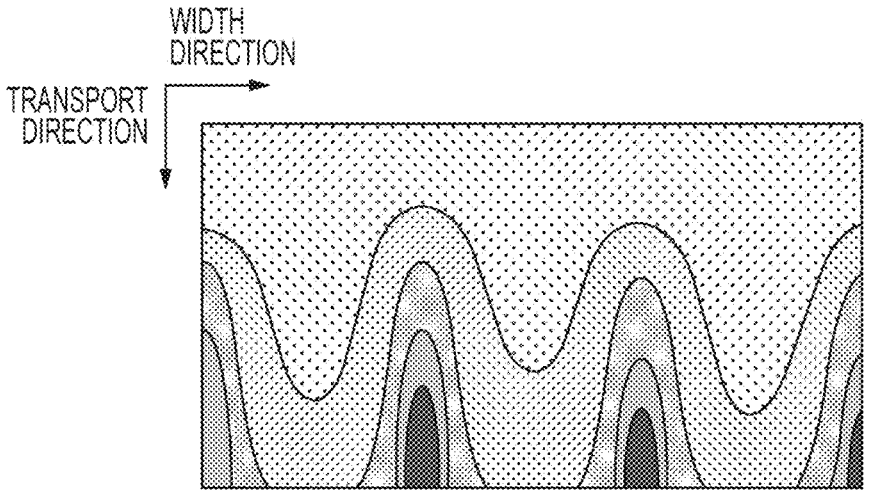
FIG. 4 is a diagram illustrating output of the floating detection sensor according to the embodiment of the invention.

FIG. 4 shows schematically the floating detection sensor 70 in the embodiment of the invention. The light and shading in FIG. 4 indicates high and low of temperatures.

The floating detection sensor 70 has a configuration in which a plurality of thermo panels which converts a heat energy to electrical energy is arranged in a two dimensional matrix, and detects a temperature distribution of the detection area X in the area as shown in FIG. 4. When the recording medium M floats with respect to the second supporting surface 55, difference of the high and low occurs and the temperature distribution occurs. Accordingly, the floating can be detected based on the temperature distribution.

Specifically, the site floated with respect to the second supporting surface 55 is insufficient in the heat conduction from the second supporting member and thus temperature falls under the influence of the outside air. If it is done in that way, a temperature difference occurs between a site floated with respect to the second supporting surface 55 and a site where the heat conduction is sufficient through contact with the second supporting surface 55 and accordingly, the temperature distribution is created. The embodiment is constituted such a manner that the minimum temperature that the recording medium M should reach is set to a threshold value at a position where the detection area X is set and the floating of the recording medium M is detected using the threshold as a reference.

For example, in a case where the temperature (preheated target temperature) when the recording medium M has reached the furthest downstream portion of the preheating section 41 is set to be within ±5° C. of the temperature (target temperature 40° C.) in the recording medium support section-heating section 42, 35° C. is set as a threshold value. Accordingly, in a case where a site is in temperature more than the threshold value, it is possible to determine that a floating of the recording medium M has occurred.

Next, an explanation of the control of transporting section 2 by the control device 80, based on the detection result of the floating detection sensor 70 will be described together with a printing operation of printer 1.

As shown in FIG. 2, if the recording medium M is transported up to the printing area on the first supporting surface 50, the printing is initiated by the ink jet head 31. In the recording medium support section-heating section 42, the first supporting member 51 becomes a predetermined temperature (40° C. in a case of the embodiment) by the heater 42*a*. The ink jet head 31 is mounted on the carriage 32 and the printing is performed by the reciprocating movement in the width direction.

The infrared heater 53 irradiates infrared rays toward a predetermined infrared irradiation range which is set on the first supporting surface 50. Since the printing area according to the ink jet head 31 is included in the infrared range, when carriage 32 is retracted from the area of recording surface on which ink is landed, the main part of the radiation spectrum is directly heated by radiation with a wavelength including 2 μm to 4 μm of area. In that case, by making the water molecules included in the landed ink vibrate and thus promoting drying by the heat generated due to their friction, fixing can be performed without creating blurring or the like with respect to the recording medium M.

At this time, if the preheating of the recording medium M in the preheating section 41 is insufficient, the recording medium M expands due to heating of the recording medium support section-heating section 42, thereby wrinkle which is a cause of poor printing due to a difference between heat expansions are occurred. In particular, as in the embodiment, in a case where the infrared heater 53 is installed in the recording medium support section-heating section 42, in order for the recording surface side of the recording medium M to be heated rapidly by the radiation heating, it is necessary to sufficiently heat the recording medium M before entering into the printing area, as counter-measurement against wrinkles.

If the recording medium M expands thermally through heating the recording medium support section-heating section 42, the floating of the recording medium M occurs between the first supporting surface 50 and the second supporting surface 55 beginning from a gap G of the transporting roll pair 24 pinching the recording medium M as a starting point (refer to FIG. 3). That is, if the heat expansion of the recording medium M progresses to GAP G that is a part which is not pinched by the driving roller 24*a* and the following roller 24*b*, the floating occurs from such state as a starting point. If the floating grows up, vertical wrinkle is extended from the installation position of the transporting roll pair 24 to both sides of the transport direction. If such vertical wrinkles infiltrate the printing area, a poor printing is caused to occur.

The floating detection sensor 70 detects floating of the recording medium M with respect to the second supporting surface 55 which is installed at a position corresponding to the gap G. Since the detection area X of the floating detection sensor 70 has a size which can include the entire dotted gap G, even though floating of the recording medium M with respect to any gap G occurs, a detection leakage can be eliminated. The floating detection sensor 70 detects floating of the recording medium M, based on the temperature distribution of the recording medium M in the detection area X. Specifically, in a case where a site having a temperature lower than the predetermined threshold value (for example, 35° C.) is detected, it is determined that the floating of the recording medium M occurs.

The detection result of the floating detection sensor 70 is outputted to the control device 80 (referring to FIG. 2). The control device 80 performs control regarding a heating state of the recording medium M on the second supporting surface 55, based on the detection result of the floating detection sensor 70. In a case where the floating detection sensor 70 detects that the floating of the recording medium M has been occurred, the control device 80 of the embodiment performs control regarding a driving of the transporting section 2 to provide a tension to the recording medium M in the second supporting surface 55 since it is determined that the heating in the preheating section 41 is insufficient.

Specifically, the control device 80 reversely drives the motor 62 of the roll driving device 61 shown in FIG. 3 to apply a back tension with respect to the recording medium M. If the tension is provided to the recording medium M through driving of the transporting section 2, the recording medium M is contacted closely along the second supporting surface 55 which is substantially curved to secure its flatness, thereby having an appropriate heating state without any floating with respect to the second supporting surface 55. Because of that, the recording medium M can be heated sufficiently on the second supporting surface 55 through heat conduction from the second supporting member 56.

Like this, if the recording medium M is sufficiently heated in the preheating section 41 by the control of the heating state of the recording medium M on the second supporting surface 55, since wrinkles are not created due to the heat expansion difference even though the recording medium support section-heating section 42 is heated, it is possible to realize a high quality printing and image forming by suppressing an clumping or bleeding of the ink landed and the like without an unevenness in drying of the ink which can be supported to the recording medium M on the first supporting member 51 of the flat plate on which has not ribs in the printing area.

Consequently, according to the embodiment as mentioned above, a printer 1 is adopted which is provided with a transporting section 2 that transports a recording medium M, an ink jet head 31 that ejects fluid to the recording medium M, a recording medium support section-heating section 42 that has a first supporting surface 50 on which the recording medium M is supported at a position opposed to the ink jet head 31 as well as heating the recording medium M on the first supporting surface 50, a preheating section 41 that has a second supporting surface 55 on which the recording medium M is supported at a upstream side of the transport direction more than the ink jet head 31 as well as along with heating the recording medium M on the second supporting surface 55, a floating detection sensor 70 that detects floating of the recording medium M with respect to the second supporting surface 55, and a control device 80 that performs control regarding a heating state of the recording medium M on the second supporting surface 55, based on the detection result of the floating detection sensor 70, thereby an insufficient heating which could not be determined with only control of a preset temperature in the preheating section 41 that heats the recording medium M in advance can be actually determined from the floating with respect to the supporting surface of the recording medium M and thus the heating state of the recording medium M on the second supporting surface 55 can be controlled based on the determination, it is possible to sufficiently heat the recording medium M before entering the printing area.

Consequently, the printer 1, that a sufficient preheating can be performed to realize a high quality printing image, can be obtained.

In the above, a preferred embodiment of the invention has been described with reference to the attached drawings, but the invention is not limited to the embodiment. All shapes, combination or the like of each constituent member as shown in the embodiment are one example and thus, various modifications are possible, based on design requirements and the like within a range without departing from the gist of the invention.

For example, in the embodiment, it has been described that the floating detection sensor 70 detects floating of the recording medium M with respect to the second supporting surface 55, but since floating of the recording medium M is created beginning from the gap G as a starting point at both sides of the transport direction, it may be a configuration in which the floating detection sensor 70 detects floating of the recording medium M with respect to the first supporting surface 50 and detects the floating of the recording medium M with respect to both sides of the first supporting surface 50 and second supporting surface 55.

Further, for example, in the embodiment, such an explanation that the floating detection sensor 70 is an infrared array sensor and detects floating of the recording medium M in the detection area X including the whole of gap G which is dotted in the width direction has been described has been described, but the invention is not limited to such a configuration.

Figure 5:
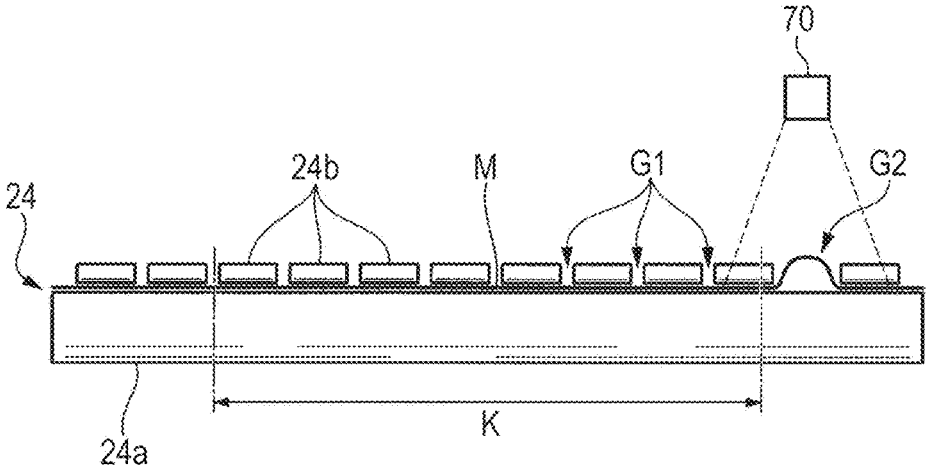
FIG. 5 is a front view illustrating a configuration of a transporting roller pair and an arrangement of the floating detection sensor of the embodiment of the invention.

For example, as in another embodiment shown in FIG. 5, the transporting roll pair 24 may be constituted to have a first gap G1 of a predetermined size and a second gap G2 greater than the first gap G1 as the gap G mentioned above and such a configuration in which the floating detection sensor 70 is installed to be able to detect the floating of the recording medium M at the position corresponding to the second gap G2 may be adopted.

The thermal expansion makes easy to retry in the second gap G2 having the wider width than that of the first gap G1 having a narrow width so that the floating is preferentially created beginning from the second gap G2 as a starting point. Because of that, if the second gap G2 greater than the first gap G1 is installed in the transporting roller pair 24 and an induction is made to create the floating of the recording medium M in the second gap G2, even if the sensor is a sensor which does not have a wide detection area, the floating of the recording medium M can be effectively detected. Accordingly, for example, as the floating detection sensor 70, a distance sensor that detects a local distance and the like can be also used.

By the way, if the second gap G2 greater than the first gap G1 is installed, the thermal expansion is preferentially guided and thereby, the vertical wrinkle which is expanded beginning from the second gap G2 as the starting point to both sides of the transport direction become larger and longer. In that case, since it is easy to exert an influence on the printing image, it is preferable to provide the second gap G2 outside the printing area K by the ink jet head 31 in the width direction. According to such configuration, a high quality printing image can be realized by the influence of the floating of the recording medium M which is guided to the second gap G2 not being exerted in the printing area K.

Further, for example, in the embodiment, such a configuration in which the control device 80 performs control to reversely drive the motor 62 of the roll driving device 61 and to provide the back tension to the recording medium M has been described, the invention is not limited to such configuration. For example, such a configuration in which the transporting speed by the roll 21 is relatively small than the transporting speed by the transporting roller pair 24 and a tension is provided to the recording medium M having such speed difference may be adopted. Further, in a case where the motor 62 of the roll driving device 61 is reversely driven and the back tension is provided to the recording medium M, it is preferable to set the timing according to the driving of the transporting roller pair 24. For example, in a case where the transporting roller pair 24 transports intermittently the recording medium M per one-pass of the ink jet head 31, if the back tension is provided when transporting is stopped, it is possible for the influence to not be exerted to the printing image. Further, a timing of the transporting/transporting-stop of the transporting roll pair 24 can be detected by the rotation detection device 68.

Further, for example, in the embodiment, such a configuration in which the control device 80 performs control with respect to driving of the transporting section 2 to provide a tension to the recording medium M on the second supporting surface 55, based on the detection result of the floating detection sensor 70 has been described, but the invention is not limited to such configuration. For example, a configuration which performs control regarding the driving of the preheating section 41 may be adopted for the control device 80 such that the heat amount per unit time which is applied to the recording medium M on the second supporting surface 55 becomes to be increased, based on the detection result of the floating detection sensor 70. According to such a configuration, since heating which can compensate for insufficient heating is possible, the recording medium M can be sufficiently heated on the second supporting surface 55 and thus the counter-measurement with respect to the wrinkles is accomplished. In that case, the control device 80 and the heater 41*a* are electrically connected with each other and when the floating of the recording medium M is detected by the floating detection sensor 70, the control device 80 performs control to increase the heating level by the heater 41*a* for example.

Further, there is no need to say that the drive control of the transporting section 2 and the drive control of the preheating section 41 can be appropriately combined and adopted.

Further, for example, in the above mentioned embodiment, a case where the recording apparatus is a printer 1 has been described as an example, but the recording apparatus is not limited and may be a machine such as a copying machine and a facsimile machine.

Further, as the recording apparatus, a recording apparatus that ejects fluid other than ink may be adopted. The invention can be used in various recording apparatuses which are provided with a recording head which ejects a small amount of droplets, for example. Further, the droplet refers to a liquid state which is ejected from the recording apparatus and the like and may include droplets having a particulate, a tear-shaped and a filamentous aftereffects. Further, the liquid mentioned herein is a preferable liquid which is able to be ejected by the recording apparatus. For example, the material may include preferable materials which are able to remain in a liquid state and includes high and low viscosities of liquid state body, sol, gel water in addition to an inorganic solvent, an organic solvent, a solution, a liquid resin, a fluid state as a liquid metal (metallic melt), materials which not only liquid as a state of a substance but also particles of a functional material from a solid body such as dyes or metal particles are dissolved, dispersed or mixed in a solvent, or the like. Further, as an example of the representative liquid, ink as described in the embodiment may be listed. Herein the ink may be inks which include various liquid compositions such as a general water-based ink, an oil-based ink, a gel ink and a hot melt ink. Further, the recording medium M may be recording mediums which include a paper, a feature paper, a synthetic paper, a board, a metal plate or the like in addition to a plastic film such as a polyvinyl chloride or a PET film.

What is claimed is:

1. A recording apparatus comprising:

a transporting device that transports a recording medium;

a recording head that ejects fluid to the recording medium;

a first supporting surface that supports the recording medium at a position opposed to the recording head;

a heating device that has a second supporting surface that supports the recording medium upstream of the recording head in a transport direction, and that heats the recording medium on the second supporting surface;

a floating detection device that detects floating of the recording medium with respect to at least one of the first supporting surface and the second supporting surface; and a control device that controls a heating state of the recording medium on the second supporting surface, based on the detection result of the floating detection device, wherein the control device controls the driving of the transporting device to provide a tension to the recording medium on the second supporting surface, based on a temperature distribution included in the detection result of the floating detection device.

2. The recording apparatus according to claim 1, wherein the control device controls the driving of the heating device to increase a heat amount per unit time which is provided to the recording medium on the second supporting surface, based on the detection result of the floating detection device.

3. The recording apparatus according to claim 1, wherein the transporting device has a transporting roller pair pinching the recording medium with a gap in a width direction intersecting the transport direction between the first supporting surface and the second supporting surface, and the floating detection device is installed to be able to detect the floating of the recording medium at a position corresponding to the gap.

4. The recording apparatus according to claim 3, wherein the transporting roller pair has a first gap having a predetermined distance and a second gap larger than the first gap, and the floating detection device is installed to be able to detect the floating of the recording medium at the position corresponding to the second gap.

5. The recording apparatus according to claim 4, wherein the second gap is installed outside a printing area by the recording head in the width direction.

6. The recording apparatus according to claim 1, wherein the floating detection device detects floating, based on temperature distribution of the recording medium.

7. The recording apparatus according to claim 1, wherein the transporting device includes:

a supplying roll that sends out the recording medium; and a driving roller that transports the recording medium sent by the supplying roll, wherein the tension is provided by a speed difference that occurs by making a transporting speed of the supplying roll smaller than a transporting speed of the driving roller, based on the temperature distribution included in the detection result.

8. The recording apparatus according to claim 1, wherein when a transporting of the recording medium is stopped, the tension is provided to the recording medium.

* * * * *